US005676888A

United States Patent [19]

Kuckens et al.

[11] Patent Number: 5,676,888

[45] Date of Patent: Oct. 14, 1997

[54] ECOLOGICAL QUALITY IMPROVEMENT OF WATER FOR DOMESTIC USE

[75] Inventors: Alexander Kuckens, Gross-Sarau; Horst Kohl, Bad Oldesloe, both of Germany

[73] Assignee: Technica Entwicklungsgesellschaft mbH & Co. KG, Germany

[21] Appl. No.: 601,009

[22] PCT Filed: Aug. 24, 1994

[86] PCT No.: PCT/DE94/00978

§ 371 Date: Feb. 23, 1996

§ 102(e) Date: Feb. 23, 1996

[87] PCT Pub. No.: WO95/05801

PCT Pub. Date: Mar. 5, 1995

[30] Foreign Application Priority Data

Aug. 25, 1993 [GB] United Kingdom ..... 4328590

[51] Int. Cl.[6] ..... B01F 3/04

[52] U.S. Cl. ..... 261/76; 261/DIG. 7; 137/98

[58] Field of Search ..... 137/98, 895; 261/DIG. 7, 261/76

[56] References Cited

U.S. PATENT DOCUMENTS

| | | | |
|---|---|---|---|
| 831,941 | 9/1906 | Erlinger . | |
| 1,958,938 | 5/1934 | Bonhandy | 261/19 |
| 2,483,426 | 10/1949 | Moore | 137/98 |
| 2,606,749 | 8/1952 | Bayers, Jr. | 261/DIG. 7 |
| 3,194,254 | 7/1965 | Zmek | 137/114 |
| 3,586,018 | 6/1971 | Bogardh et al. | 137/67 |
| 3,851,797 | 12/1974 | Jacobs | 261/DIG. 7 |
| 4,185,054 | 1/1980 | Nakamura et al. | 137/895 |
| 4,650,667 | 3/1987 | Eguchi et al. | 424/44 |
| 4,666,707 | 5/1987 | Eguchi et al. | 424/44 |
| 4,726,080 | 2/1988 | Henkin et al. | 4/542 |
| 4,760,865 | 8/1988 | Rilett | 137/588 |
| 4,820,408 | 4/1989 | Sandig | 137/895 |
| 4,827,966 | 5/1989 | Takano et al. | 137/100 |
| 5,026,551 | 6/1991 | Yorozu et al. | 424/44 |

FOREIGN PATENT DOCUMENTS

| | | |
|---|---|---|
| 0155683 | 3/1985 | European Pat. Off. . |
| 0170269 | 7/1985 | European Pat. Off. . |
| 0176694 | 4/1986 | European Pat. Off. . |
| 0525292 | 2/1993 | European Pat. Off. . |
| 0525449 | 2/1993 | European Pat. Off. . |
| 288517 | 2/1914 | Germany . |
| 819322 | 9/1951 | Germany . |
| 1491563 | 7/1969 | Germany . |
| 3006065 | 8/1980 | Germany . |
| 3618726 | 12/1986 | Germany . |
| 3610266 | 10/1987 | Germany . |
| 3840567 | 6/1990 | Germany . |
| 4026283 | 2/1991 | Germany . |
| 4144728 | 10/1992 | Germany . |
| 802691 | 8/1958 | United Kingdom . |
| 927011 | 5/1963 | United Kingdom . |

OTHER PUBLICATIONS

Karl Holl, Wasser, 1979, Walter de Gruyter—Berlin, pp. 11, 112, 113.

Leonhard A. Hutter, Wasser und Wasseruntersuchung, Diesterweg Salle Sauerlander, p. 89.

Dreisbach, 1971, Handbook of Poisoning: Diagnosis & Treatment (Seventh Edition), pp. 186–187.

Copenhaver and Johnson, 1958, Bailey's Textbook of Histology (Fourteenth Edition), pp. 284–292.

Dr. W. A. Ritschel, 1966, Der Pharmazeutische Betrieb, vol. 7, Die Tablette Grundlagen und Praxis des Tablettierens, Granulierens und Dragierens, pp. 107–110.

*Primary Examiner*—Tim R. Miles

*Attorney, Agent, or Firm*—Eckert Seamans Cherin & Mellott

[57] ABSTRACT

The invention provides an apparatus for improving the water quality for hair and body care, wherein an exact impregnation ratio between CO2 and water may be maintained even at low water pressure by using a step piston 11, namely by using CO2 compressed gas cartridges which are refillable with CO2 compressed gas, and by eliminating cartridges into which water or moisture has penetrated.

24 Claims, 2 Drawing Sheets

ECOLOGICAL QUALITY IMPROVEMENT OF WATER FOR DOMESTIC USE

BACKGROUND OF THE INVENTION

1. Field of the Invention

The invention relates to ecological quality improvement of normal water for domestic use (tap water) for one or both of skin and hair treatment, particularly in connection with CO2 compressed gas cartridges being suited and intended for using with said apparatus. From the German patents DE4124728C2, DE4117023.7C2, DE4200467C2 apparatuses and CO2 compressed gas cartridges—suited for use with said apparatuses—are known, which apparatuses and cartridges serve for an ultra-fine or micro-impregnation of normal water for domestic use (tap water) with CO2 in a simple and effective way, so that said water may be used for natural body and hair care, e.g. in connection with usual shower arrangements, whereby the empty cartridges to be disposed remain as waste (throw-away products).

2. Prior Art

The object of the invention is to improve said apparatuses and the CO2 compressed gas cartridges belonging to them under an ecological point of view and with regard to their more universal applicability as well as with regard to a more exact or controlled and dosed addition of CO2 if the water pressure varies or, particularly, if it is low.

In the case of the above mentioned apparatuses, the ultra-fine or micro-impregnation with CO2 compressed gas is controlled by the water pressure in the conduit via a yielding or flexible (elastic) membrane. This control is reliable in case of normal water pressure. However, there are numerous cases of application, e.g. if tap water heated in flow heaters or instantaneous water heaters is used, in which cases the available water pressure is substantially lower than the normal tap water pressure. Thus, the available water pressure may be lower than 1,5 bar. In such cases, in which only a low pressure water source is available, the control by a membrane is not sufficient to guarantee the full function of the automatically adjusted and correctly dosed addition of CO2. For this reason, the invention uses a double diameter or step piston element separating the water-inlet chamber and the compressed gas-inlet chamber. By using a step piston element, an exactly dosed addition of the CO2 gas to the impregnating zone is possible even in case of low water pressure because the pressure on both sides of the piston meets two different surfaces. By preselecting the step piston element, i.e. by predetermining its effective piston surfaces, each particular situation of use may be taken into account in a simple manner, even a low water pressure being in a position to produce the valve control or adjustment power.

The power which is produced on the water side via the bigger of both piston surfaces is in case of very low water pressure already equal to the power which is produced on the other side via the small piston surface and which adjusts itself to the same value only at a much higher CO2 pressure (balance of the piston). By using a double diameter piston element it is therefore possible to control and to adjust much higher CO2 pressure as corresponding to the available tap water pressure.

This measure is of advantage generally in case of low tap water pressure and also particularly in those cases where a particular CO2 check valve is provided, as shown herein. Depending on the intended purpose of use, the ratio of the piston surfaces may vary for example between 1:1 to 1:5 and more; preferably it is about 1:3,5.

In case a compressed gas cartridge with refill valve is used, a direct control of said refill valve by said step piston is made possible so that said refill valve may be used as a discharge or withdrawal valve exactly controlled by the step piston element for a dosed discharge of the CO2 gas into the impregnating zone.

By using a step piston it is also made possible in a simple manner to lock said step piston in a position ineffective with respect to the refill valve by means of an element which is operable from outside in order to be able to supply non-treated water via the apparatus e. g. to the shower head.

The controllable valve may be integrated in the body of the apparatus and nevertheless be controlled directly by the step piston. If, however, a compressed gas cartridge with integrated refill valve is used, it is of particular importance to avoid that water from the impregnating zone penetrates into the compressed gas inlet chamber and from there into the cartridge. This may be avoided by providing a check valve in the flow communication between the compressed gas inlet chamber and the impregnating zone. For this purpose a spring-loaded disk valve, particularly a silicon disk valve, is used.

The use of said spring-loaded silicon check valve, which is provided in the valve housing however results in an opening power of about 0.6 bar. If the water pressure acting upon a control membrane is to low, first of all the power to open the valve in the CO2 cartridge has to be applied for a controlled and dosed addition of CO2, in which cartridge the internal pressure already amounts to about 60 bar at 20° C., and additionally the opening pressure of about 0,6 bar for the check valve has to be overcome. This problem is to be solved easily by using the double diameter or step piston described above. On the CO2 controlling side a CO2 pressure is adjusted which depending on the predetermined piston ratio achieves a value being for example already 3 times higher at a very low water pressure.

Said check valve, which is for example made of silicon, is provided primarily to avoid the repenetration of water into the used cartridge. On the other hand, a characteristic feature of spring-loaded silicon valves of the mentioned type is that in case of a particular arrangement of the valve seat has they produce audible but not unpleasant whistling sounds when for example CO2 gas is streaming through. This characteristic feature is welcome since this whistling sound enables an acoustic control of the functioning of the apparatus and the CO2 supply. When washing hair and taking a shower, a function display on the apparatus is not always suitable. For this reason the silicon check valve may be lodged in an additional resonance pipe amplifying the whistling sound or at least passing it on in such a way that it is clearly audible. For this purpose the resonance pipe may additionally be rubber-cushioned.

The impregnating zone may be provided in a suitable manner, e.g. as shown in DE4124728C2. However, another protected low pressure method may be used as well, as illustrated in FIG. 1, which is described below. However, the CO2 gas may as well be passed into the impregnating zone under overpressure with respect to the static water pressure in the impregnating zone.

The use of refillable compressed gas cartridges (CO2 compressed gas containers) for a broad application of such apparatuses and accompanying CO2 "suppliers" is preferable for ecological reasons, thus saving raw materials and helping to use the CO2 transport containers (the cartridges) several times and nevertheless safely. When using refillable cartridges, a considerable problem consists in the possible penetration of moisture or water into the discharged cartridges. This may be caused by defective apparatuses, e.g. by failure of the check valves or by use of the cartridges for other purposes.

According to the prescriptions, the CO2 cartridges have to be absolutely dry when filled with gas in order to avoid the formation of H2CO3 in the cartridge. The carbonic acid being formed would attack the steel shell from imide and thus reduce the security of the pressure body and expose the users to danger.

SUMMARY OF INVENTION

The invention solves this problem by using a bearing element which yields or weakens or is destroyed automatically in the presence of moisture, said bearing element being particularly a hygroscopic tablet as counter-bearing of the valve spring. By using hygroscopic agents, e.g. chlorides, in this case primarily calcium chlorides, tablets or pellets are produced on normal pelleting machines by means of binding agents particularly suited for this purpose, and they are pressed in such a way that they obtain the desired consistency or stability.

Said stability or consistency is predetermined in such a way that in normal dry condition the tablet (firstly) resists the spring pressure of the valve spring and (secondly) the filling power F—filling pressure P multiplied by surface A of the valve.

If, due to any circumstances whatever, water penetrates into empty cartridges, the tablet dissolves or softens and looses its consistency. The preloaded valve spring alone is already in a position to press the softened mass or substance into the interior of the cartridge. Not later than the cartridge is to be refilled on a filling device, the entire valve, i.e. spring and valve rod, is pushed into the interior of the cartridge and the cartridge is no longer able to lock itself. Such defective cartridges can easily be eliminated by automatic weight controls, because it is not possible to hold CO2 under pressure in such cartridges.

Said bearing element, which is yielding or weakening or being destroyed automatically, may be located with respect to the flow communication of the compressed gas between the interior of the compressed gas cartridge and the interior of the refill valve in such a way that the moisture penetrating into the cartridge is conducted to the close vicinity of the bearing element, so that said bearing element yields or weakens or is destroyed quickly. The material of the bearing element may be selected in such a way that its hygroscopy is sufficient to obtain the yielding condition with respect to the spring via the moisture produced in the interior of the cartridge.

The CO2 valve size is particularly adapted to hold the opening power very small despite the relatively high pressure in the interior of the cartridge.

Throw-away cartridges already in use may be recycled to be re-usable as cartridge pressure bodies by slight finishing work on their necks. The cartridge pressure body and the valve body are encapsulated with each other in an ideal manner by a special bending procedure, so that at the same time a groove for a sealing ring (O-ring) between the cartridge and the apparatus is provided.

The valve rod may be dislocated to the back with respect to the surface of the valve body, so that it is not possible to operate or to open the valve without a tool (safety device for children).

The above mentioned prior art apparatuses are adjusted corresponding to their respective purpose of application, so that, independently from the attention of the user, the water taken from a shower or the like and refined to be used for skin and hair care has the optimum pH-value. Practical experience has shown that a pH-value of 5.2 is very advantageous for hair care, whereas a pH-value of 5.8 is sufficient for cosmetic skin care. The influence on the acid protecting coat of the skin which can be re-established as well as it is not damaged when showering, is also regarded as cosmetic skin care. A modification of the acid protecting coat has been noticed for example in the case of neurodermitis or psoriasis, which layer may be re-established with ultra-fine or micro-impregnated water.

In order to broaden the possibility of application of the apparatus, the invention provides a possibility for the user to vary the pH-value from the most preferable value for hair care to the optimum value for skin care and vice versa by simply shifting a lever. This saves CO2 gas in the cartridge, and thus it is not necessary to exchange the cartridges so often. The invention is described in detail by schematic drawings on the basis of several embodiments.

DETAILED DESCRIPTION OF THE PREFERRED EMBODIMENTS

Figure 1:
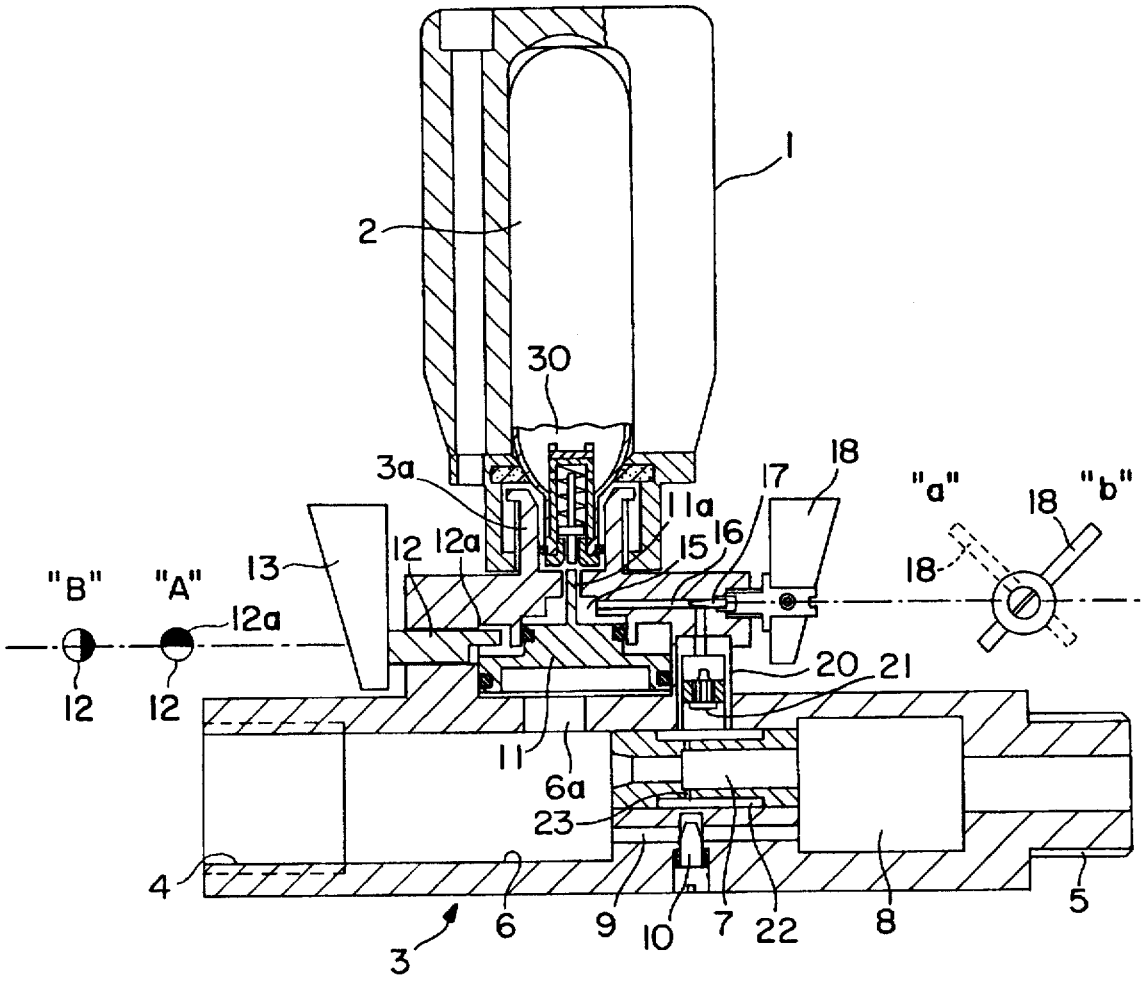
FIG. 1 is a longitudinal section through an apparatus with inserted refillable compressed gas cartridge.

The apparatus comprises a support or mounting 1 for a CO2 compressed gas cartridge 2 which is inserted into the seat 3a of the body 3 of said apparatus with its reduced neck. Said body comprises a connection means 4 for connection to a water source, particularly to a usual water conduit, as well as a connection means 5 for a tapping device, e.g. a shower, or the like. Both of said means are disposed substantially in the same direction with respect to the axis and are interconnected via a water inlet chamber 6, an impregnating zone 7 and a secondary mixing chamber 8. In the illustrated example, said impregnating zone 7 consists of a body through which water from said inlet chamber 6 flows at an accelerated speed. Subsequently to a steplike enlargement, inlet openings 23 of a small diameter are provided which openings connect said impregnating zone 7 with a compressed gas distribution chamber 22. Said chamber is interconnected with an opening 16 via a flow communication being locked against the penetration of water by a spring-loaded silicon disk valve, which opening leads into a CO2 compressed gas inlet chamber 15. A needle-shaped throttle element 17 is provided at said opening, said throttle element 17 determining the cross section of stream and being variable or shiftable between positions"a" and"b" by a lever 18 which is accessible or operable from outside. Said two positions are for example adjusted at a pH-value of 5.2 (for hair care) and a pH-value of 5.8 (for cosmetic skin care), which pH-value is determined by the impregnation of the water with CO2.

In the illustrated embodiment, said CO2 compressed gas-inlet chamber 15 is separated from said water-inlet chamber 6 by a step piston element 11, the smaller effective surface of which is located in the direction of said compressed gas inlet chamber 15. The effective piston surface ratio may be adjusted exactly to each case of application desired by exchanging the step piston element, which application results from the respective water pressure but also from the customer's requests regarding the pH-value of the ultra-fine or micro-impregnated water.

The step piston comprises a push rod 11*a* protruding into said seat 3*a* of the CO2 compressed gas cartridge. In the situation illustrated in FIG. 1, said step piston element 11 is in its retracted ineffective position. It may be locked in said position by a locking member 12, 12*a* shiftable from outside, e.g. via a lever 13, so that normal water, i.e. without CO2 impregnation, may be taken from the respective water source when opening the shower valve, which is not shown.

Figure 2:
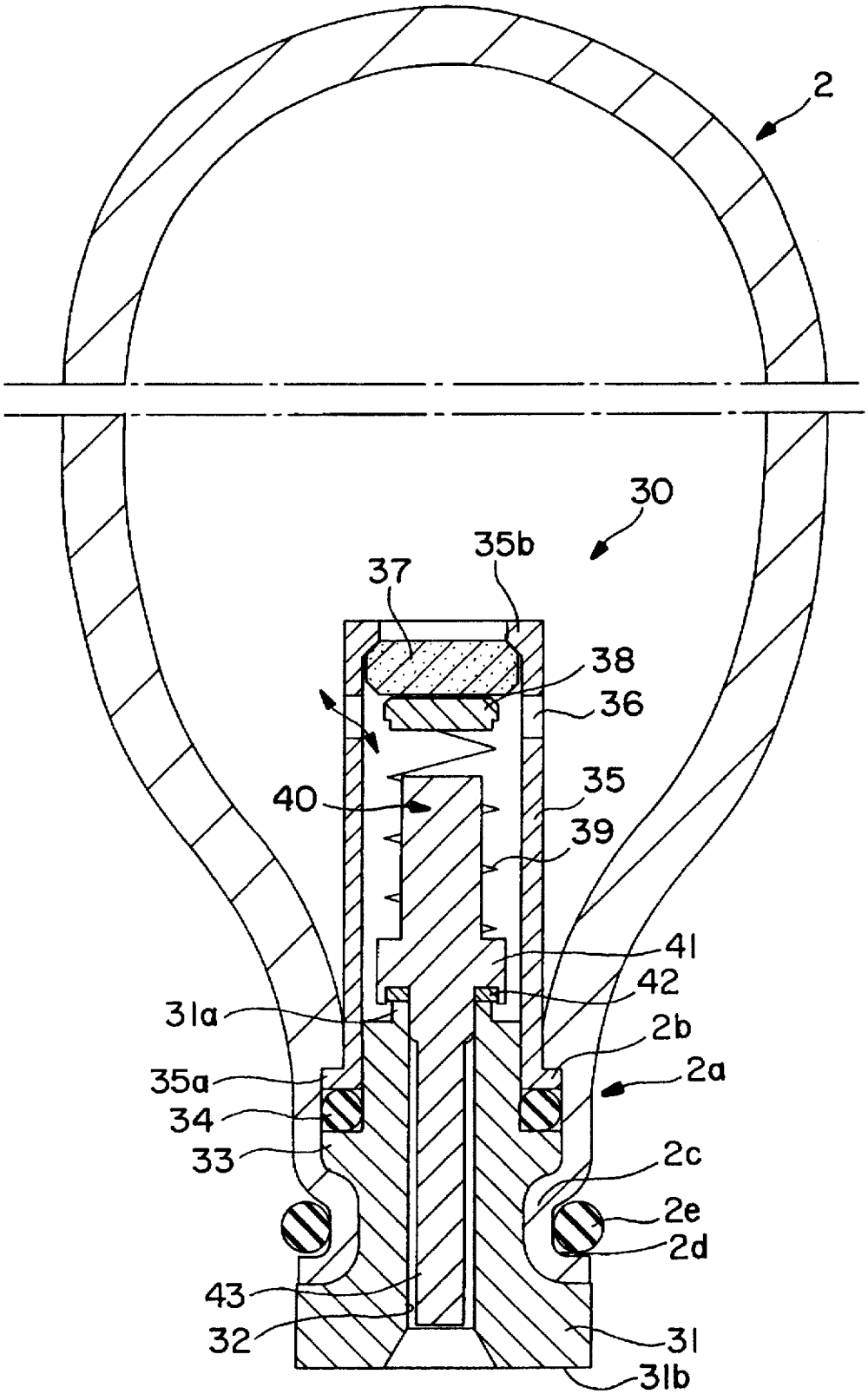
FIG. 2 is a longitudinal section through a refillable CO2 compressed gas cartridge, which may be inserted into the apparatus according to FIG. 1 and which is an enlarged view of cartridge 2 with refilling valve 20 schematically illustrated in FIG. 1.

The withdrawal of compressed gas from said cartridge 2 is effected via a valve 30. It may be integrated in said body 3 between said seat and said compressed gas-inlet chamber. In the illustrated example, however, said valve 30 is provided directly at said compressed gas cartridge 2 as refill and withdrawal valve, as illustrated more in detail in FIG. 2.

The neck 2*a* of said compressed gas cartridge 2 is shaped in such a way that it comprises an inner shoulder 2*b* and a constriction or bending 2*c* located in axial distance from said shoulder. The valve body 31 of the refilling valve 30, a sealing 34 and the flange 35*a* of a bushing 35 are solidly and tightly clamped between said shoulder 2*b* and said constriction 2*c*. Said constriction 2*c* is provided so as to form a receiving groove 2*d* which is open in radially outward direction for a sealing element 2*e* serving for a tight insertion of the cartridge into said seat 3*a* of the apparatus.

In the valve body 31*b* a moveable valve member 40 is guided which member is provided with a sealing ring 42 under a collar 41, which sealing ring cooperates with or engages a ring-shaped valve seat 31*a* of the valvebody 31 for locking said cartridge 2 in outward direction. Said valve member 40 is provided with a valve rod 43 protruding through said valve body 31 by which rod the refill valve 30 may be operated in a controlled manner via said step piston 11 and its push rod 11*a* respectively, so that said refill valve 30 serves as a withdrawal valve for dosed quantities at the same time. A spring 39 is threaded on the shaft-shaped projection of said valve member 40, which spring presses said valve member tightly upon said valve seat 31*a* when said cartridge 2 is empty. Said spring backs up a pressure distribution disk 38 with its rear end, which disk lies upon a bearing element 32. Said bearing element is supported by an inner flange 35*b* of said bushing 35. In the close vicinity of said bearing element 37, said bushing 35 is provided with openings 36 through which the CO2 compressed gas may stream into and out of said cartridge 2.

Said bearing element 37 is adapted and located so as to yield when water or moisture occurs inside the cartridge or the refill valve 30, so that said valve member 40, 42 is no longer pressed tightly upon said valve seat 31*a* and thus the cartridge is no longer able to hold or retain CO2 compressed gas. In an automatic refilling procedure, non-filled defective cartridges may easily be eliminated by weight control. The automatic yielding or weakening or destruction of said bearing element is achieved by using a bearing element made of or containing a hygroscopic material. Said bearing element may be produced automatically in tablet form on usual pelleting machines from such materials. Appropriate blasting agents causing, accelerating or supporting the dissolution or the decomposition of such tablets or pellets are well-known (compare "Der pharmazeutische Betrieb" Vol. 7, "Die Tablette, Grundlagen und Praxis des Tablettierens, Granulierens und Dragierens" by Dr. W. A. Ritschel, Editio Cantor KG/Aulendorf in Württemberg, particularly pages 107 ff.).

The invention provides an apparatus for improving the water quality for hair and body care, wherein an exact impregnation ratio between CO2 and water may be maintained even at low water pressure by using a step piston 11, namely by using CO2 compressed gas cartridges which are refillable with CO2 compressed gas, and by eliminating cartridges into which water or moisture has penetrated.

We claim:

1. Apparatus for improving the quality of tap water for at least one of skin and hair treatment comprising, (a) a body having a water-inlet and water-outlet, said water-inlet being connectable to a water source operable to provide water pressure, said water-inlet being coupled to an impregnation zone;

(b) a water-inlet chamber being water-tight against a compressed gas-inlet chamber by a step piston element which is exposed to said water pressure;

(c) a CO2 compressed gas cartridge connectable with said compressed gas-inlet chamber via a seat and a controllable valve being controlled by said step piston element responsive to the water pressure and said gas-inlet chamber being connected with said impregnating zone via a flow communication.

2. Apparatus according to claim 1, wherein said step piston element is provided with a push rod extending into said gas-inlet chamber for controlling said controllable valve.

3. Apparatus according to claim 1, wherein said controllable valve is located in said apparatus body between said seat for the cartridge and said gas-inlet chamber.

4. Apparatus according to claim 1, wherein said controllable valve is a refilling valve attached to said CO2 compressed gas cartridge being replaceably lodged in said seat.

5. Apparatus according to claim 4, wherein the cartridge has a face and the controllable valve has a valve rod located backwards offset with respect to the face of the cartridge.

6. Apparatus according to claim 4, wherein the controllable valve has a closing spring which acts upon a valve member which is movable between an open and closed position, the spring being operable to preload the valve member in the closed position, the spring being supported by a bearing element automatically yielding in the presence of moisture.

7. Apparatus according to claim 6, wherein said bearing element consists of a hygroscopic material decomposing in the presence of moisture and optionally having the form of a pellet.

8. Apparatus according to claim 1, further comprising a locking member which is operable to lock said piston in a position ineffective with respect to said controllable valve.

9. Apparatus according to claim 1 further comprising a throttle valve in said flow communication between said compressed gas-inlet chamber and said impregnating zone said throttle valve being variable between at least two different throttle positions.

10. Apparatus according to claim 1, further comprising a check valve in said flow communication between said compressed gas-inlet chamber and said impregnating zone, said check valve being operable to impede the flow of water from the water supply into the compressed gas inlet chamber.

11. Apparatus according to claim 10, wherein said check valve is a spring loaded disk valve which produces an audible sound with the flow of gas.

12. Apparatus according to claim 11, wherein said check valve is located in a resonance pipe.

13. Apparatus according to claim 1, wherein said water-inlet chamber and a subsequent secondary mixing chamber coupled behind said impregnating zone, is connected via a bypass conduit, bypassing said impregnating zone and having a cross section of stream being adjustable by adjusting means.

14. Apparatus according to claim 2, wherein said push rod of said piston controls said controllable valve directly via the valve rod.

15. Apparatus according to claim 1 wherein said CO2 compressed gas cartridge comprises a pressure-proof cartridge body with a reducing neck in which said controllable valve is inserted tightly, said controllable valve being provided with a locking member which is movable between a locked and unlocked position, said locking member being preloaded by a spring, in the direction of the locked position, said spring being supported by a bearing element within said cartridge body, wherein said bearing element at least yields in the presence of moisture.

16. Apparatus according to claim 15, wherein said bearing element comprises a hygroscopic material operable to decompose in the presence of moisture and optionally having the form of a tablet or pellet.

17. Apparatus according to claim 15, wherein said bearing element is a tablet or pellet comprising blasting agents causing, facilitating or accelerating its decomposition.

18. Apparatus according to claim 16, wherein the spring has at least one end and the pellet has at least one surface and a pressure distributing disk is provided between the end of the spring and the surface of the pellet.

19. Apparatus according to claim 15, wherein said bearing element is located in the close vicinity of openings in said controllable valve through which openings the CO2 pressure gas streams on the way to and from said cartridge body from and to said controllable valve respectively.

20. Apparatus according to claim 15, wherein said controllable valve is held tightly between an inner shoulder and a constriction of said neck.

21. Apparatus according to claim 20, wherein said constriction of said neck is adapted to receive a sealing element by forming a groove being open in radially outward direction.

22. Apparatus according to claim 15, wherein said controllable valve is provided as a controllable compressed gas withdrawal valve.

23. Apparatus according to claim 15, wherein said locking member of said controllable valve is provided with a valve rod protruding through the withdrawal and refill opening of said cartridge.

24. Apparatus according to claim 23, wherein when the locking member is in the locked position, the free end of said valve rod is substantially dislocated to the back with respect to the surface of said cartridge and of said controllable valve respectively.

* * * * *